US006629391B1

(12) United States Patent
Børresen et al.

(10) Patent No.: US 6,629,391 B1
(45) Date of Patent: Oct. 7, 2003

(54) WINDOW FOR INSTALLATION IN A ROOF AND A MOUNTING BRACKET FOR USE IN THE INSTALLATION OF ROOF PENETRATING STRUCTURES

(75) Inventors: Bjarne Børresen, Søborg (DK); Claes Lindgren, Farum (DK); Lars Jørn Nissen-Schmidt, Søborg (DK); Wayne Quarles, Greenwood, SC (US)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 09/611,317

(22) Filed: Jul. 6, 2000

(51) Int. Cl.[7] ..... E04B 7/18
(52) U.S. Cl. ..... 52/200; 52/712; 52/714
(58) Field of Search ..... 52/200, 712, 714

(56) References Cited

U.S. PATENT DOCUMENTS

| | | | | | |
|---|---|---|---|---|---|
| 834,462 | A | * | 10/1906 | Faught | |
| 4,897,979 | A | * | 2/1990 | Colonias | 52/643 |
| 4,920,713 | A | | 5/1990 | Borressen et al. | |
| 4,932,173 | A | * | 6/1990 | Commins | 52/92 |
| 5,274,981 | A | * | 1/1994 | Commins | 52/712 |
| 5,590,503 | A | * | 1/1997 | Spronken | 52/677 |
| 5,598,680 | A | * | 2/1997 | Wilhelmi | 52/715 |
| 5,617,694 | A | * | 4/1997 | Baba | 52/712 |
| 5,664,392 | A | * | 9/1997 | Mucha | 52/715 |
| 5,682,713 | A | | 11/1997 | Weiss | |
| 6,230,467 | B1 | * | 5/2001 | Leek | 52/702 |

FOREIGN PATENT DOCUMENTS

| | | |
|---|---|---|
| DE | 24 36 049 A1 | 2/1976 |
| WO | WO88/04348 | 6/1988 |

* cited by examiner

*Primary Examiner*—Carl D. Friedman
*Assistant Examiner*—Yvonne M. Horton
(74) *Attorney, Agent, or Firm*—Venable LLP; John P. Shannon; Chad C. Anderson

(57) ABSTRACT

A window for installation in a roof includes a window frame with frame pieces and mounting brackets. Each bracket includes an angular bracket member with first and second legs connected integrally with each other, and a substantially plate-shaped base member having an opening for receiving fasteners and is connected with the outer side wall of the frame piece. The angular bracket member is connected with the base member such that, in a transportation position of the window, the second leg of the angular bracket member protrudes inwards in relation to the base member, and, in an installation position, the second leg protrudes outwards. Locking mechanism locks the first leg relative to the base member in the installation position, and adjusting mechanism adjusts the position of the angular bracket member in at least a transverse direction perpendicular to the longitudinal direction of the frame piece of the window frame.

28 Claims, 6 Drawing Sheets

WINDOW FOR INSTALLATION IN A ROOF AND A MOUNTING BRACKET FOR USE IN THE INSTALLATION OF ROOF PENETRATING STRUCTURES

BACKGROUND OF THE INVENTION.

The present invention relates to a window for installation in a roof of the type having an inclined roof surface and an underlying supporting structure, said window comprising a window frame with frame pieces, each extending in a longitudinal direction and having an outer side wall defining a plane substantially perpendicular to the roof surface, and a plurality of mounting brackets; wherein each mounting bracket comprises: an angular bracket member having a first and a second leg connected integrally with each other, and a substantially plate-shaped base member having at least one opening for receiving fastening means and being connected with the outer side wall of the window frame piece, said base member defining a plane which is parallel to said outer side wall plane, the angular bracket member being connected with the base member in such a way that in a transportation position of the window the second leg of said angular bracket member protrudes inwards in relation to the plane of the base member, whereas in an installation position of the window, the second leg protrudes outwards in relation to said plane.

Windows for installation in inclined roof surfaces are normally supplied in a package and are anchored in the supporting structure of the roof by means of a number, usually four or six, of mounting brackets supplied in a separate package. The mounting brackets, which are sectionally L-shaped, are by one leg fastened to the side pieces of the window frame, and the window is then mounted in the roof opening made to that purpose in the roof surface and fastened by the second leg by screws to the underlying roof supporting structure, the rafters or the battens.

When the window is to be installed in roofs having a sheathing to which the roofing is secured, the window is normally fixed on top of the sheathing. As the window frame is placed in this way, and there is thus no need for adjusting the mounting brackets with respect to the window frame, it is known from U.S. Pat. No. 4,920,713 to secure the mounting brackets on the window at the factory by forming each mounting bracket with a positioning member abutting against the outer side wall of the frame, which positioning member is connected with the first leg by an integrated hinge connection, such that the first leg is able to be swung from the transportation position, in which it abuts against the outer side wall of the window frame, to its installation position in which it abuts against the positioning member. Following this operation, mounting screws are inserted and tightened or mounting nails are driven home, thereby fixing the first leg to the window frame.

Pre-mounting of the mounting brackets entails a number of advantages, ia. that a correct positioning is ensured, that the risk of loosing one or more brackets before the window is installed is avoided, and that the installation time is reduced.

However, for roof structures in general, adjustment of the position of the window frame in relation to the plane of the roof surface is normally necessary in order to obtain the desired position of the window.

In e.g. the international publication No. WO 88/04348, adjustment of the position of the window frame in relation to the roof surface normally takes place at the installation site by performing the necessary measuring operations in order to establish the correct position of the mounting brackets in the transverse direction of the frame piece, following which the mounting brackets are fastened in one of a number of grooves extending in the longitudinal direction of the frame pieces, said grooves being mutually spaced in the transverse direction. Due to the fact that adjustment takes places at the installation site it is not considered convenient to pre-mount such mounting brackets, the more so as the second leg of the bracket would be protruding from the plane of the window frame, thereby necessitating a larger packaging and there is also a risk of damaging the brackets or of the bracket causing damage to other objects.

BRIEF SUMMARY OF THE INVENTION.

It is an object of the invention to provide a window of the kind mentioned by way of introduction, in which the installation conditions are improved even further and the requirements to tools and fastening means such as screws and nails which have to be carried along by the installer are minimized.

It is another object of the invention to provide a window, in which mounting brackets may be pre-mounted but where it is nevertheless possible to adjust the position of the window in relation to the roof surface, regardless of the type of roof supporting structure in question.

It is a further object to provide a mounting bracket for use in the installation of a roof penetrating structure.

These objects are obtained in that in each mounting bracket, locking means are provided for locking the first leg of the angular bracket member in relation to the base member in the installation position, and adjusting means are provided for adjusting the position of the angular bracket member in at least a transverse direction perpendicular to the longitudinal direction of the frame piece of the window frame.

The adjusting means makes it possible to displace the angular bracket member in relation to the plane of the roof surface without having to perform any measuring operations before fastening the brackets to the window frame. By providing the mounting brackets themselves with means for locking the first leg to the base member, the need for screws and nails for this purpose is rendered superfluous. By the combination of these features, the simple installation aimed at is thus obtained.

In a first preferred embodiment of the invention, each mounting bracket comprises a connecting portion connecting a first side edge of the first leg of the angular bracket member integrally with a first side edge of the base member, and wherein the first leg abuts against the window frame in the transportation position, and is swung into a position in which it abuts against the base member in the installation position, the connecting portion defining the axis of the swinging, said locking means comprising at least one lug at a second side edge of the base member opposite said first edge, which lug in the installation position is received in a corresponding cut-out at or near a second edge of the first leg opposite said first edge and to abut against the outer side thereof.

In a second preferred embodiment, the base member comprises a raised portion defining a plane situated at a distance from the plane of the remaining portion of the base member thereby forming a gap for receiving the first leg of the angular bracket member, said locking and adjusting means comprising a tongue which in one end is fastened to the raised portion of the base member in the vicinity of a side edge thereof and which at a distance from said end is provided with a projection protruding inwards through a hole in the raised portion of the base member and cooperates with a corresponding hole in the first leg of the angular bracket member.

In a third preferred embodiment, means are provided for temporary securing of the first leg of the angular bracket member in relation to the base member in the transportation position of the window. The temporary securing means may comprise at least one lug at a respective side edge of the base member, each of said lugs being adapted to cooperate with a corresponding cut-out in a respective side edge of the first leg of the angular bracket member.

BRIEF DESCRIPTION OF THE SEVERAL VIEWS OF THE DRAWING.

Embodiments of the invention will now be described in more detail with reference to the schematic drawings, in which.

DETAILED DESCRIPTION OF THE INVENTION.

Figure 1:
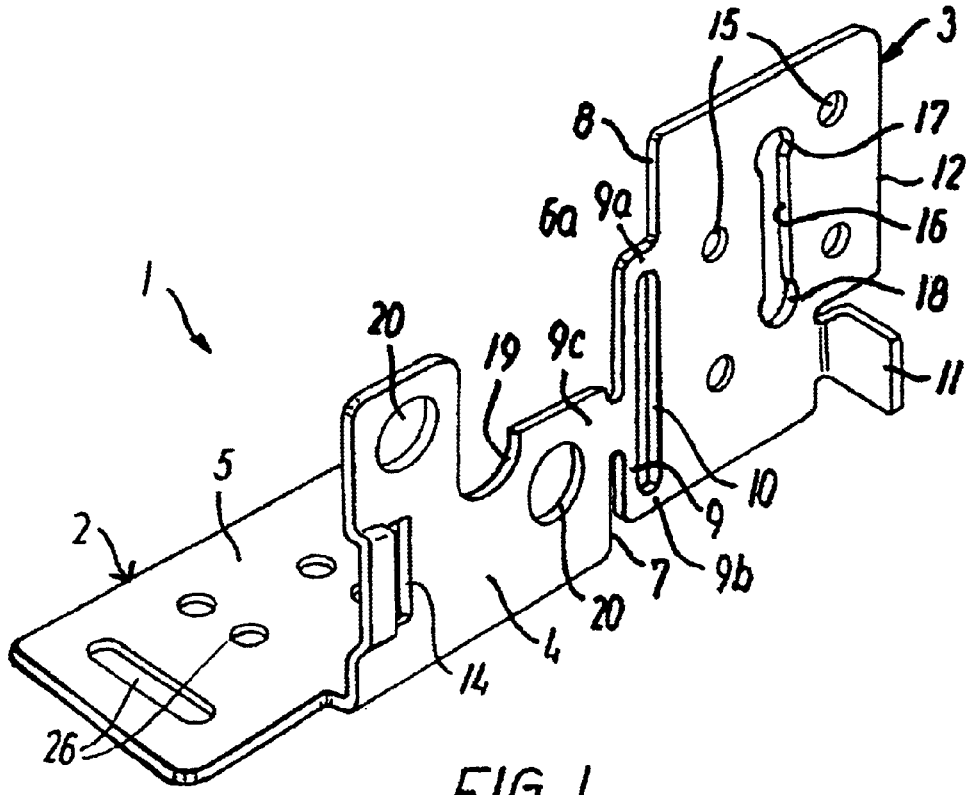
FIG. 1 shows a perspective view of a mounting bracket in a first preferred embodiment of the invention.

FIG. 1 illustrates a mounting bracket generally designated 1 and (comprising an angular bracket member 2 and a substantially plate-shaped base member 3. The angular bracket member 2 has a first leg 4 and a second leg 5 extending at substantially right angles from the lower edge of the first leg 4 and in integral connection therewith. The angular bracket member 2 is connected with the base member 3 by means of a connecting portion 6 extending between respective first side edges 7 and 8 of the first leg 4 of the angular bracket member 2 and the base member 3, respectively. The connecting portion 6 comprises a bridge 9 connected integrally at each end 9*a*, 9*b* with the first side edge 8 of the base member 3, and at a central portion 9*c* with the first side edge 7 of the first leg 4 of the angular bracket member 2, thus forming a gap 10 between the bridge 9 and the first edge 8 of the base member 3.

The mounting bracket 1 is furthermore provided with locking means for locking the angular bracket member 2 in relation to the base member 3 as will be explained in further detail below. To this end, a lug 11 is provided at a second side edge 12 opposite the first side edge 8 of the base member 3. Near a second side edge 13 of the first leg 4 of the angular bracket member 2, an opening in the shape of a cut-out 14 is formed. The cut-out 14 could as an alternative be positioned at the very edge 13.

The base member 3 is provided with a number of openings for receiving fastening means in order to secure the mounting bracket 1 to a roof penetrating structure, such as e.g. a roof window. In the embodiment shown, these openings comprise four substantially circular holes 15 and a slot 16 extending substantially in parallel with the first and second side edges 8, 12 of the base member 3 and having at each end a widened section 17 and 18, respectively.

The first leg 4 of the angular bracket member 2 is provided with a recess 19 at its upper edge and two holes 20 having a larger diameter than the holes 15 of the base member 3. The second leg 5 is likewise provided with a plurality of openings 26 intended for receiving mounting nails or screws when securing the mounting bracket and thus the roof penetrating structure to an underlying roof supporting structure at an installation site. The shape, position and number of these openings 26 may vary, as may the shape of the entire second leg 5. In the embodiment shown, the longitudinal dimension of the second leg 5 is somewhat larger than that of the first leg 4 but the second leg 5 could be of any suitable design.

Figure 2:
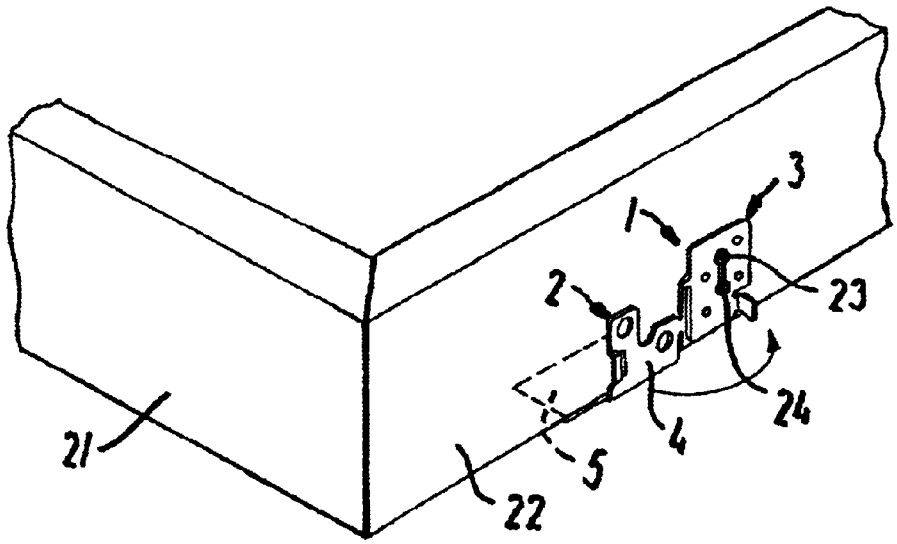
FIG. 2 shows a perspective view of the mounting bracket of FIG. 1 mounted on a window in a, transportation position.

In FIGS. 1 and 2, the mounting bracket 1 is shown in a transportation position, ie. the position the bracket assumes when mounted on a roof penetrating structure, such as a window, of which parts of two adjoining frame pieces 21, 22 is shown in FIG. 2, in e.g. a package in which the window is stored and transported to the installation site. Each mounting bracket 1 of a total of e.g. two or three is fastened to one frame piece 22, usually each side frame piece of the window, by two screws 23 and 24 which are inserted at a respective widened end section 17 and 18 of the base member slot 16 and are driven into possibly pre-drilled holes, not shown, in the outer side wall 27 of the frame piece 22. In this position, the second leg 5 of the angular bracket member 3 protrudes inwards from the plane of the outer side wall and is positioned below the under side of the frame piece 22. The lug 11 on the base member 3 may be positioned as shown, ie. protruding at an angle from the base member 3, or as an alternative lie in the plane of the base member.

At the installation site, the window is unpacked and each mounting bracket 1 is brought to its installation position by swinging the angular bracket member 2 through an angle of substantially 180° until the first leg 4 abuts against the base member 3. During this swinging operation, the bridge 9 of the connecting portion 6 undergoes a permanent torsional deformation. Prior to this operation, it is seen to that the lug 11 protrudes at substantially right angles from the base member 3 in order to secure that the lug 11 is positioned correctly with respect to the cut-out 14 in the first leg 4. Following this, the lug 11 is deformed by means of e.g. a hammer impact to abut against the outwardly facing side of the first leg 4, thus assuming the position shown in FIG. 3.

Figure 3:
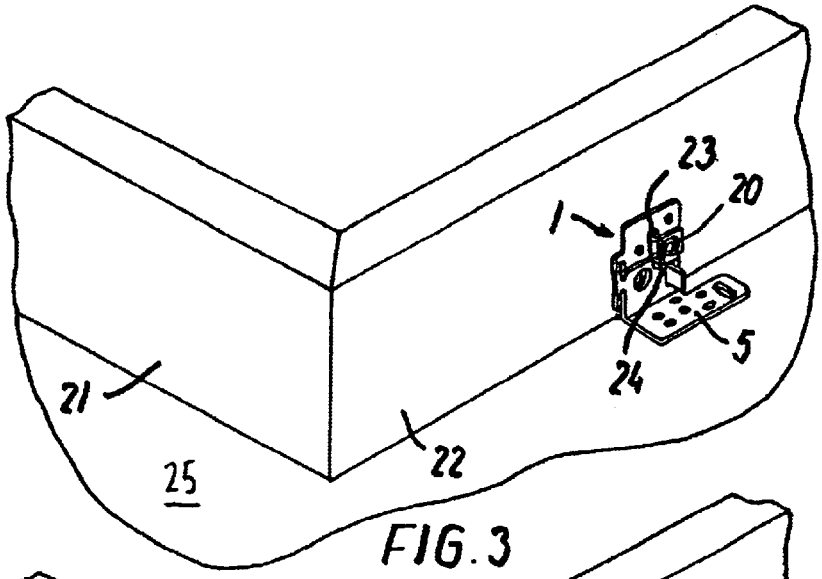
FIGS. 3 and 4 are views corresponding to FIG. 2 of the window in two different installation positions.

At the installation site shown in FIG. 3, a sheathing 25 is positioned on an underlying roof supporting structure, not-shown. In the sheathing, an aperture corresponding to the outer dimensions of the window frame has been prepared prior to placing the window on the sheathing, such that the second leg 5 of the angular bracket member 2 rests on the upper surface of the sheathing. In case the sheathing 25 forms a substantially plane roof surface, there is usually no need for adjustment of the mounting brackets 1 in the transverse direction of the window frame, ie. the direction perpendicular to the longitudinal direction of the frame piece 22. After adjustment of the position of the window with respect to the aperture in the sheathing 25, mounting screws or nails are inserted into the openings 26 in the second leg 5 and are tightened or driven home, whichever appropriate, thus securing the window frame to the sheathing. It is noted in this respect that the angular bracket member 2 and the base member 3 are locked in relation to each other by the engagement between the lug 11 and the cut-out 14. Additional screws of nails may optionally be inserted through the holes 20 and 15 in the first leg 4 and the base member 3, respectively, of which the two holes 20 in the first leg 4 overlap the holes 15 in the base member 3 in the installation position. It may furthermore be seen in FIG. 3 that the recess 19 in the first leg 4 overlaps the lower end of the slot 16 in the base member 3.

Figure 4:
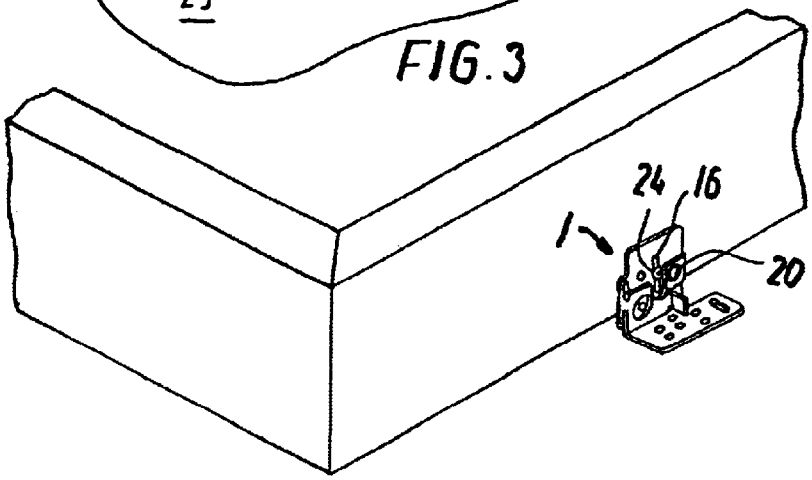

An installation site requiring an adjustment in the transverse direction of the window frame pieces 21, 22 is shown in FIG. 4. In this case, the adjusting means of the mounting bracket 1 are used in order to assure correct positioning of the window with respect to the roof supporting structure and the roofing. In the embodiment shown, the screw 23 at the upper end of the base member slot 16 is unscrewed and the lower screw 24 is loosened slightly in order to allow displacement of the first leg 4 and thus the entire mounting bracket 1 downwards, ie. in the transverse direction of the window frame pieces 21, 22. The screw 24 is re-tightened in the desired position of the mounting bracket 1 and one or more screws (e.g. the previously removed screw 24) is inserted into some of the holes 20, 15 in the first leg 4 and the base member 3, which are still positioned opposite the window frame piece 22.

Figure 5:
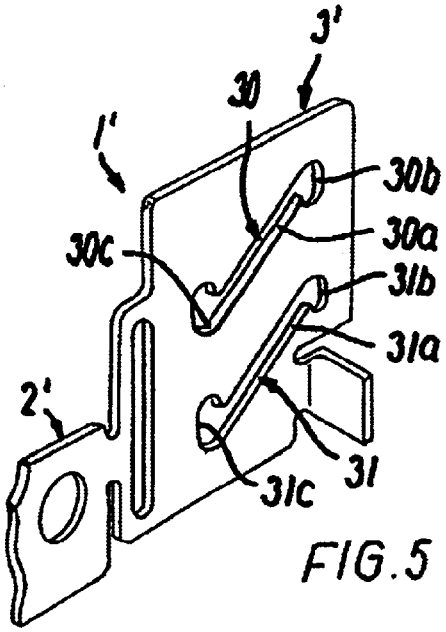
FIGS. 5 and 6 are views corresponding to FIG. 1 of two alternative designs of a detail of the mounting bracket of FIG. 1.
Figure 6:
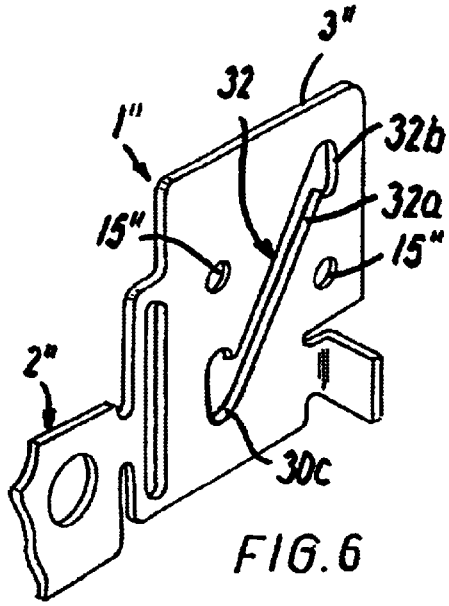

FIGS. 5 and 6 illustrate alternative designs of the adjusting means of a mounting bracket generally designated 1' and 1", respectively, which are of substantially the same design as the mounting bracket of the embodiment shown in FIGS. 1 to 4. It is understood, however, that other parts of the mounting brackets 1' and 1" may have to undergo certain adaptations in order to conform to the adjusting means.

In the embodiment shown in FIG. 5, two slots 30 and 31 having mutually parallel and obliquely extending portions 30*a* and 31*a*, respectively, are substituted for the holes 15 and the slot 16 in the base member 3 of the embodiment shown in FIGS. 1 to 4. At the end of each slot 30 and 31, the end portions form recesses 30*b*, 30*c* and 31*b*, 31*c*, respectively, which are intended for receiving fastening means in the form of screws or nails. When adjusting the position of the base member 3' and thus the angular bracket member 2' in the transverse direction of the frame piece of the roof penetrating structure, to which the mounting bracket is fastened, a displacement in the longitudinal direction of the frame piece takes place simultaneously. Such a longitudinal displacement is normally of no importance, or might in some cases even be useful, e.g. in case of roof supporting structures comprising rafters and battens, in which placing of a mounting bracket opposite a cut batten end may be avoided.

In the embodiment shown in FIG. 6, there is only one slot 32 in the base member 3" of the mounting bracket 1". The slot 32 has an obliquely extending portion 32*a* a recess 32*b*, 32*c* at each end, which are intended for receiving fastening means corresponding to the desired position of the mounting bracket 1" on the frame piece. Two holes 15" corresponding to the holes 15 in the base member 3 of the embodiment illustrated in FIGS. 1 to 4 are provided in order to obtain an adequate securing of the mounting bracket 1" to the frame piece.

Figure 7:
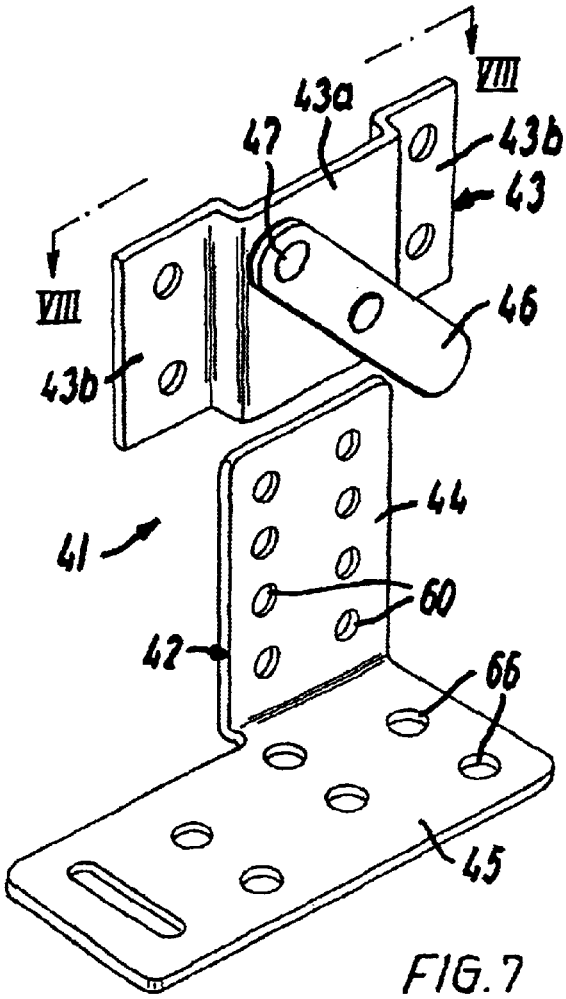
FIG. 7 shows a perspective view of the parts of a mounting bracket in a second preferred embodiment of the invention.
Figure 8:
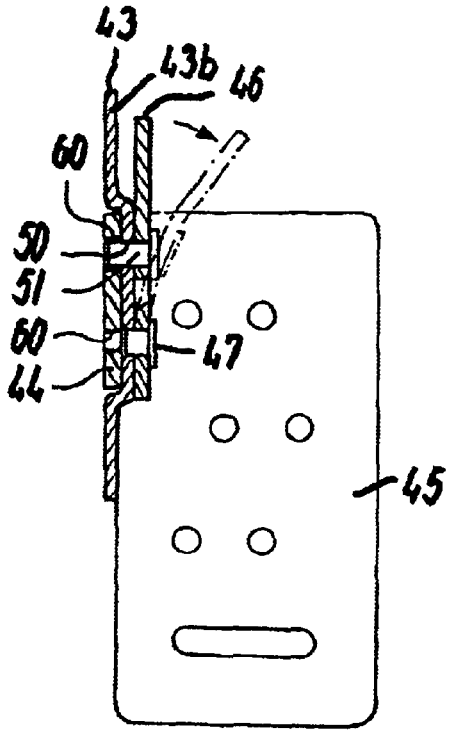
FIG. 8 is a sectional view of the mounting bracket of FIG. 7, along the line VIII—VIII in this Figure.

FIGS. 7 to 11 illustrate a second preferred embodiment of a mounting bracket generally designated 41. In FIG. 7 the parts of the mounting bracket 41, ie. an angular bracket member 42 and a base member 43 are shown separated from each other for reasons of clarity only. It should be noted that these parts are connected with each other in the transportation position as well as in the installation position as will be explained in further detail in the following.

As in the embodiments described in the above, the angular bracket member 42 comprises a first leg 44 and a second leg 45 formed integrally with each other. The base member 43 comprises a comprises a raised portion 43*a* which defines a plane situated at a distance from the plane of the remaining portion 43*b* of the base member 43. In the mounted position of the mounting bracket 41, fastening screws or nails 63 are inserted through holes 55 in the remaining portion 43*b* of the base member as shown in e.g. FIG. 9. The distance between said two planes is dimensioned in such a way that the first leg 44 of the angular bracket member 42 may be received in the gap formed between the remaining portion 43*b* of the base member 43 and the window frame piece 62 (cf. FIG. 8). In the vicinity of one side edge of the raised portion 43*a* of the base member 43, a tongue 46 is fastened permanently in one end thereof by means of a fastening means 47 such as e.g. rivet. At a distance from the rivet 47 the tongue 46 is on its back side provided with a projection 51 protruding inwards through a hole 50 in the raised portion 43*a* of the base member 43. In the transportation and installation positions of the mounting bracket 41, when the first leg 44 of the angular bracket member 42 is received in the gap behind the raised portion 43*a* of the base member 43, this projection 51 cooperates with one of a plurality of openings or holes 60 in the first leg 44 of the angular bracket member 42. By the provision of such a plurality of holes, in the embodiment shown six holes 60 distributed on two columns and three rows, a combined locking and adjusting means is provided as the angular bracket member 42 may be adjusted and locked in relation to the base member 43 in a number of different positions as will be explained in the following.

Figure 9:
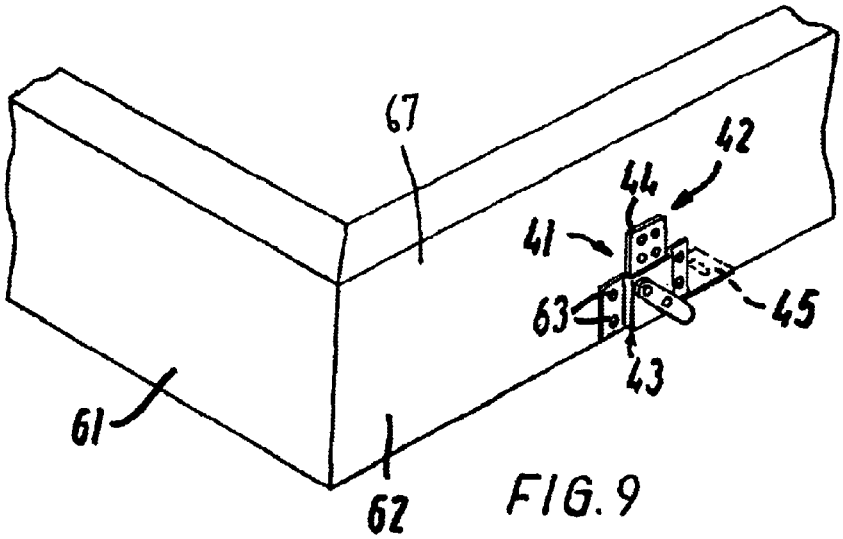
FIG. 9 shows a perspective view of the mounting bracket of FIG. 7 mounted on a window in a transportation position.

In FIG. 9, the mounting bracket 41 is shown in its transportation position in which the first leg 44 of the angular bracket member 42 has been inserted into the gap between the raised portion 43*a* of the base member 43 and the outer side wall 67 of the window frame piece 62 by lifting the free end of the tongue 46, ie. the end opposite the rivet 47, and subsequently releasing said free end in the intended position of the first leg 44, thus letting the projection 51 on the tongue 46 engage one of the holes 60 in the first leg 44. In the position shown in FIG. 9, the second leg 45 of the angular bracket member 42 protrudes inwards in relation to the planes of the base member and the outer wall 67 of the window from piece 62 below the under side of the frame piece 62. Alternatively, the angular bracket member 42 could be inserted from above into the gap in the bracket member by its first leg 44, such that the second leg 45 protrudes inwards but above the upper side of the frame piece 62.

Figure 10:
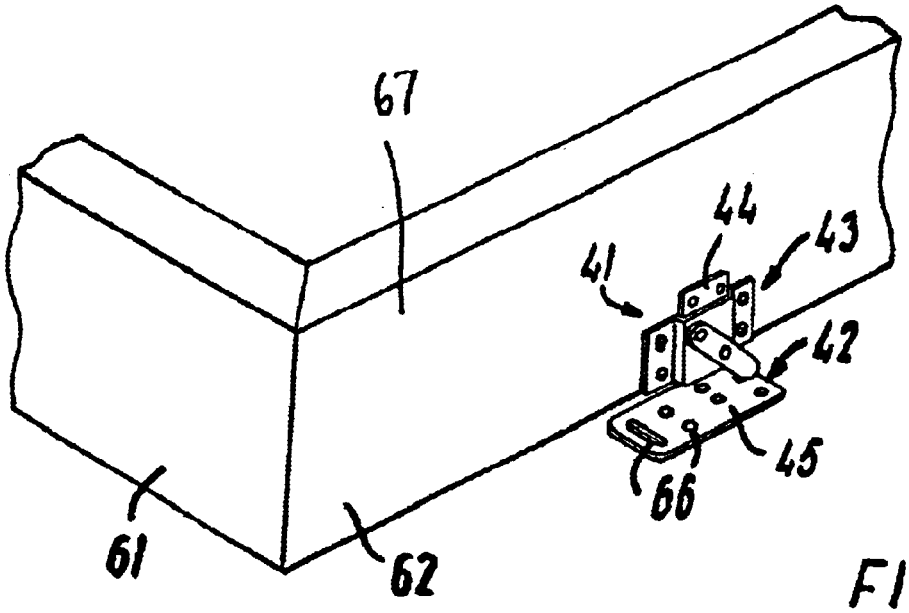
FIGS. 10 and 11 are views corresponding to FIG. 9 of the window in two different installation positions.
Figure 11:
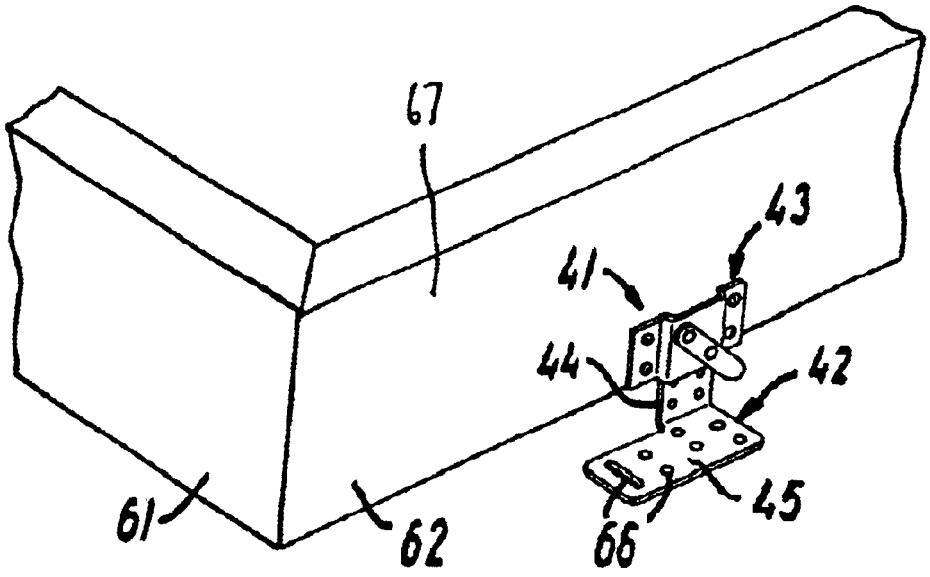
Figure 12:
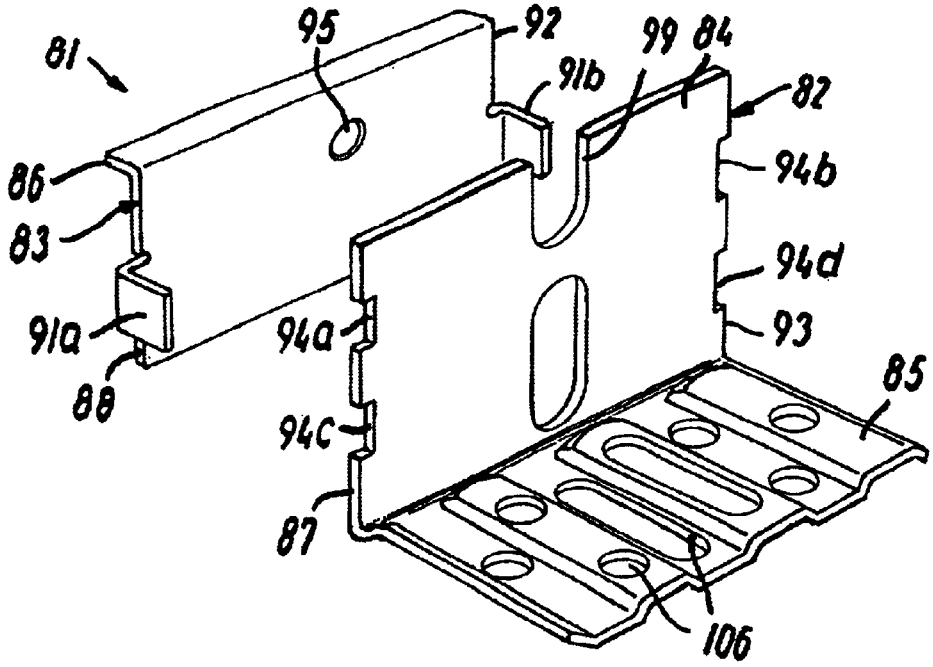
FIG. 12 shows a perspective view of the parts of a mounting bracket in a third preferred embodiment of the invention.

At the installation site each mounting bracket 41 is placed in its installation position by lifting the tongue 46, thus releasing the engagement between the projection 51 and the corresponding hole 60, and withdrawing the first leg 44 from the base member gap. The angular bracket member 42 is subsequently turned and the first leg 44 is re-inserted into the gap in such a way that the second leg 45 protrudes outwards from the window frame piece 62 and is adjusted in the transverse direction of the frame piece 62 according to the roof supporting structure, ie. as shown in FIG. 10 or FIG. 11. The mounting bracket 41 may now be fastened to the supporting structure by means of mounting screws or nails Which are inserted into the holes 66 in the second leg 45 of the angular bracket member 42, and are tightened or driven home, whichever appropriate.

FIGS. 12 to 16 illustrate a third preferred embodiment of a mounting bracket generally designated 81 and comprising a base member 83 and an angular bracket member 82. As mentioned in connection with the embodiment shown in FIGS. 7 to 11, these parts are shown separately for reasons of clarity only.

The base member 83 is mainly plate-shaped and has in the embodiment shown at its upper edge a bent portion 86 to be received in a groove 102*a* in a frame piece 102 of a window or similar roof penetrating structure in the transportation and installation positions of the mounting bracket 81. At a central portion of the base member 83 an opening or a hole 95 is provided for receiving fastening means such as screws or nails in order to secure the base member 83 to the outer wall 107 of the window frame piece 102. The base member 83 is furthermore provided with lugs 91*a* and 91*b* at a first and second side edge 88 and 92, respectively, which lugs are intended for cooperation with corresponding cut-outs 94*a–d* in a first leg 84 of the angular bracket member 82 in a manner which will be explained further on.

In addition to the cut-outs 94*a–d*, the first leg 84 of the angular bracket member 82 comprises a recess 99 and a slot 100 at a central portion of the first leg. The second leg 85 in as in the previous embodiments designed with a number of openings 106 for receiving mounting screws or nails to be connected with the underlying roof structure at the installation site.

Figure 13:
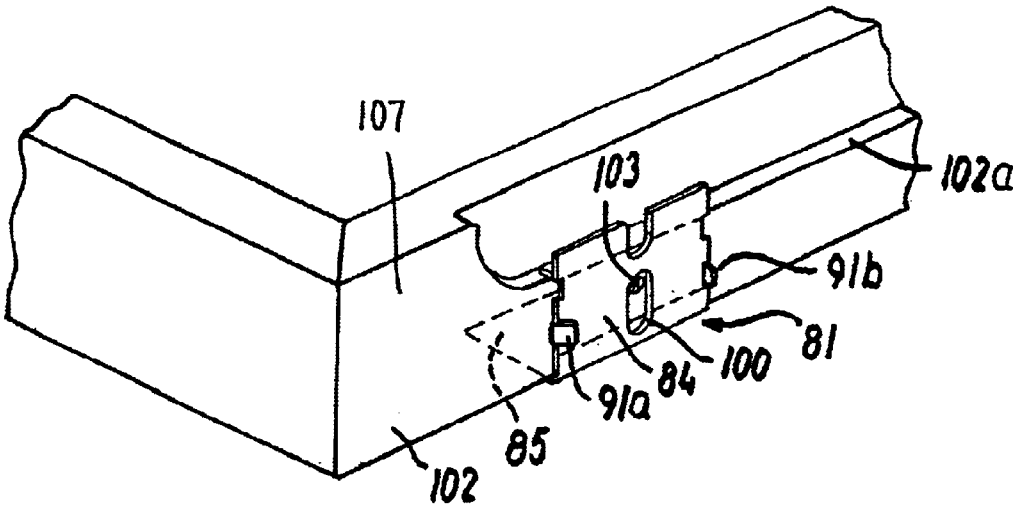
FIG. 13 shows a perspective view of the mounting bracket of FIG. 12 mounted on a window in a transportation position.

In the transportation position of the mounting bracket 81 shown in FIG. 13, the base member 83 is fastened to the outer wall 107 of the window frame piece 102 by means of a screw 103 inserted into the hole 95, the bent portion 86 being inserted into the groove 102*a* in the window frame piece 102. The angular bracket member 82 is positioned on the base member 83 in such a way that the respective one of the lugs 91*a* and 91*b* are received in the lower set of cut-outs 94*d* and 94*c*, respectively, and the second leg 85 protrudes inwards under the window frame piece 102. The angular bracket member 82 is held temporarily in this position in that the lug 91*a* at the first side edge 88 is folded and forms an acute angle with the base member 83, whereas the lug 91*b* at the other side 92 is only folded slightly and protrudes at substantially right angles to the base member 83. The slot 100 in the first leg 84 of the angular bracket member 82 overlaps the hole 95 in the base member 83 in this position and the screw 103 is thus accommodated within the slot 100.

At the installation site each mounting bracket 81 is brought to its installation position by bending the bent lug 91*a* to a protruding position by means of e.g. a hammer. The angular bracket member 82 is removed and subsequently turned, and is positioned with the second leg 85 of the angular bracket member 82 protruding outwards so that the lugs 91*a*, 91*b* are received in the upper or the lower set of cut-outs according to the roof supporting structure in question.

Figure 14:
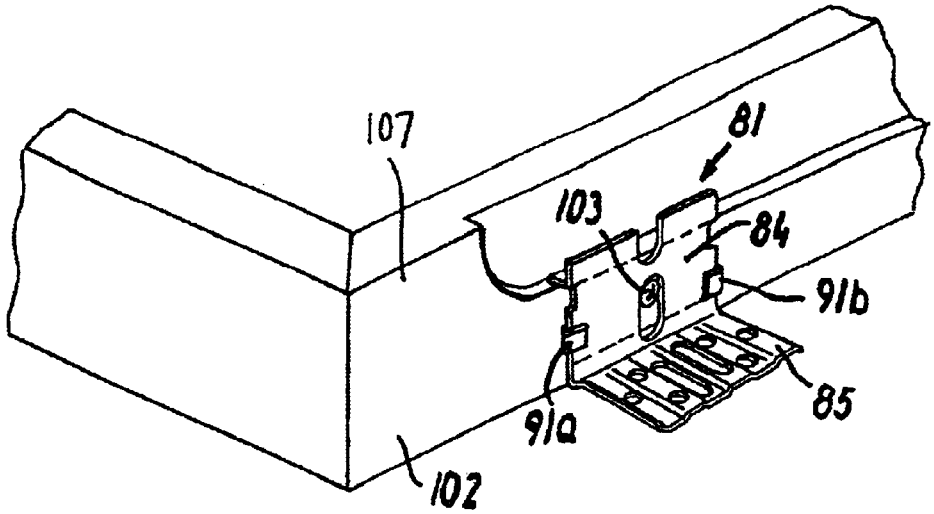
FIGS. 14 to 16 are views corresponding to FIG. 13 of the window in three different installation positions

In the installation situation shown in FIG. 14, in which the window is to be installed on a substantially plane roof supporting surface such as a sheathing, the lugs 91*a* and 91*b* are thus received in the lower set of cut-outs 94*c* and 94*d*, respectively, following which the lugs 91*a*,91*b* are tapped down into abutment with the outwards facing side of the first leg 84, and mounting screws or nails are inserted through the openings 106 in the second leg 85 and connected with the sheathing.

Figure 15:
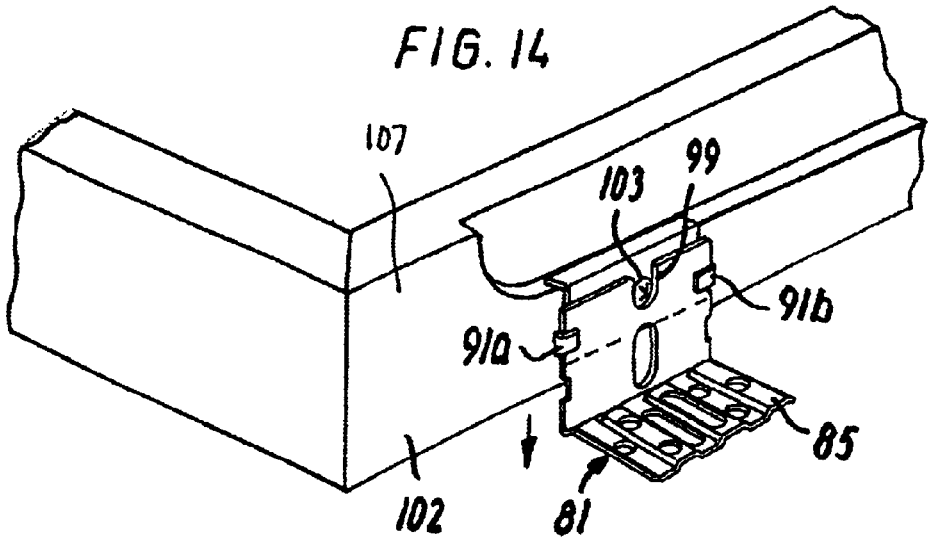

In a roof supporting structure comprising rafters and battens, not shown, the angular bracket member 82 is positioned as shown in FIG. 15, ie. in such a way that the lugs 91*a* and 91*b* are received in the upper set of cut-outs 94*a* and 94*b*, respectively. The screw 103 fixing the base member 83 to the window frame piece 102 is in this position received in the recess 99 of the a first leg 84. The lugs 91*a*, 91*b* are tapped down and the mounting bracket 81 is connected with the supporting structure in a manner corresponding to the one described in the above.

Figure 16:
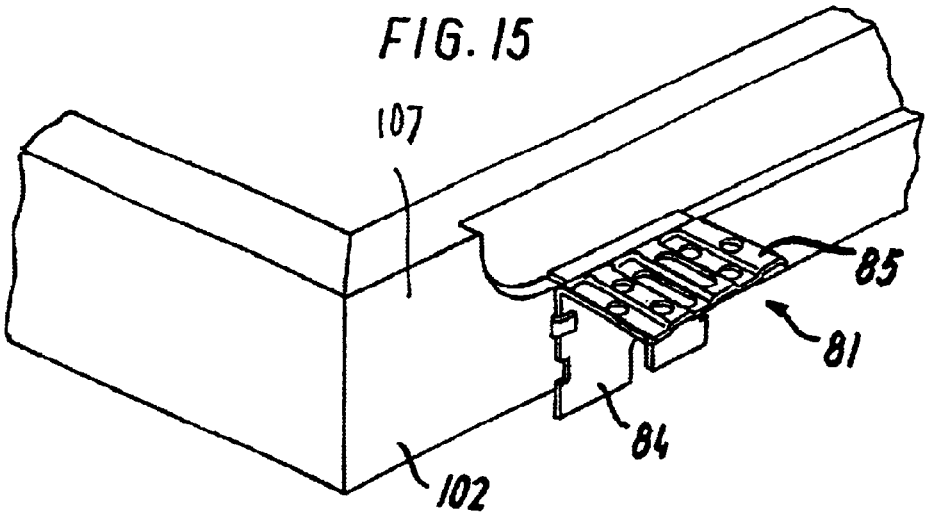

As an alternative installation possibility, the first leg 84 of the angular bracket member 82 may be inserted from above as shown in FIG. 16.

The invention should not be regarded as being limited to the embodiments described in the above but various modifications and combinations of the shown embodiments may be carried out without departing from the scope of the following claims.

For example, although the invention has been described only with reference to windows, it is of course possible to apply it to different kinds of roof penetrating structures.

What is claimed is:

1. A window for installation in a roof of the type having an inclined roof surface and an underlying supporting structure, said window comprising a window frame with frame pieces, each extending in a longitudinal direction and having an outer side wall defining a plane substantially perpendicular to the roof surface, and a plurality of mounting brackets; wherein each mounting bracket comprises:

an angular bracket member having a first and a second leg connected integrally with each other, and a substantially plate-shaped base member having at least one opening for receiving fastening means and being connected with the outer side wall of the window frame piece, said base member defining a plane which is parallel to said outer side wall plane, the angular bracket member being connected with the base member in such a way that, in a transportation position of the window, the second leg of said angular bracket member protrudes inwards in relation to the plane of the base member, whereas in an installation position of the window, the second leg protrudes outwards in relation to said plane, in which locking means are provided for locking the first leg of the angular bracket member in relation to the base member in the installation position, and adjusting means are provided for adjusting the position of the angular bracket member in at least a transverse direction perpendicular to the longitudinal direction of the frame piece of the window frame and parallel to the outer side wall.

2. A window as claimed in claim 1, wherein each mounting bracket comprises a connecting portion connecting a first side edge of the first leg of the angular bracket member integrally with a first side edge of the base member, and wherein the first leg abuts against the window frame in the transportation position, and is swung into a position in which it abuts against the base member in the installation position, the connecting portion defining the axis of the swinging, said locking means comprising at least one lug at a second side edge of the base member opposite said first edge, which lug in the installation position is received in a corresponding cut-out at or near a second edge of the first leg opposite said first edge and to abut against the outer side thereof.

3. A window as claimed in claim 2, wherein said adjusting means comprises at least one slot having an upper and a lower end and extending in the transverse direction of the frame piece.

4. A window as claimed in claim 3, wherein said at least one slot has a widened section at each of said ends.

5. A window as claimed in claim 3, wherein said first leg is provided with at least one recess which in the installation position overlaps the lower end of said at least one slot.

6. A window as claimed in claim 2, wherein said adjusting means comprises at least one slot, each of which having a portion extending obliquely in the plane of the base member.

7. A window as claimed in claim 6, wherein said adjusting means comprises two slots having mutually parallel and obliquely extending portions, and wherein each end portion of said slots forms a recess constituting said fastening means receiving openings.

8. A window as claimed in claim 1, wherein means are provided for temporary securing of the first leg of the angular bracket member in relation to the base member in the transportation position of the window.

9. A window as claimed in claim 8, wherein said securing means comprise at least one lug at a respective side edge of the base member, each of said lugs being adapted to cooperate with a corresponding cut-out in a respective side edge of the first leg of the angular bracket member.

10. A window as claimed in claim 9, wherein said at least one lug at one side edge of the base member, in the transportation position, protrudes at an angle of substantially 90° from the plane of the base member, whereas the at least one lug at the other side edge is folded and forms a smaller angle with said plane.

11. A window as claimed in claim 10, wherein each lug of the base member in the installation position is folded to abut against the outer side of the first leg of the angular bracket member.

12. A window as claimed in claim 9, wherein each side edge of the first leg of the angular bracket member comprises at least two cut-outs, and the first leg is provided with a slot which in the installation position overlaps at least one of said at least one opening in the base member.

13. A window as claimed in claim 1, wherein the base member comprises a raised portion defining a plane situated at a distance from the plane of the remaining portion of the base member thereby forming a gap for receiving the first leg of the angular bracket member, said locking and adjusting means comprising a tongue which in one end is fastened to the raised portion of the base member in the vicinity of a side edge thereof and which at a distance from said end is provided with a projection protruding inwards through a hole in the raised portion of the base member and cooperates with a corresponding hole in the first leg of the angular bracket member.

14. A window as claimed in claim 13, wherein a plurality of holes are provided in the first leg.

15. A mounting bracket for use in the installation of a roof penetrating structure, wherein said mounting bracket comprises:

an angular bracket member having a first and a second leg connected integrally with each other, and a substantially plate-shaped base member having at least one opening for receiving fastening means, said base member being intended for connection with the roof penetrating structure and defining a plane, the angular bracket member being connected with the base member in such a way that, in a transportation position, the second leg of said angular bracket member protrudes inwards in relation to said plane, whereas in an installation position, the first leg of said angular bracket member is parallel to said plane and the second leg protrudes outwards in relation to said plane, in which locking means are provided for locking the first leg of the angular bracket member in relation to the base member in the installation position, and adjusting means are provided for adjusting the position of the angular bracket member in a direction parallel to the substantially plate-shaped base member when the angular bracket member is in the installation position.

16. A mounting bracket as claimed in claim 15, wherein the mounting bracket comprises a connecting portion connecting a first side edge of the first leg of the angular bracket member integrally with a first side edge of the base member, and is swung into a position in which it abuts against the base member in the installation position, the connecting portion defining the axis of the swinging, said locking means comprising at least one lug at a second side edge of the base member opposite said first edge, which lug in the installation position is folded to be received in a corresponding cut-out at or near a second edge of the first leg opposite said first edge and abuts against the outer side thereof.

17. A mounting bracket as claimed in claim 16, wherein said adjusting means comprises at least one slot having an upper and a lower end.

18. A mounting bracket as claimed in claim 17, wherein said at least one slot has a widened section at each of said ends.

19. A mounting bracket for use in the installation of a roof penetrating structure, wherein said mounting bracket comprises:

an angular bracket member having a first and a second leg connected integrally with each other, and a substantially plate-shaped base member having at least one opening for receiving fastening means, said base member defining a plane, the angular bracket member being connected with the base member in such a way that, in a transportation position, the second leg of said angular bracket member protrudes inwards in relation to said plane, whereas in an installation position, the second leg protrudes outwards in relation to said plane, wherein locking means are provided for locking the first leg of the angular bracket member in relation to the base member in the installation position, and adjusting means are provided for adjusting the position of the angular bracket member in a direction parallel to the substantially plate-shaped base member, wherein the mounting bracket comprises a connecting portion connecting a first side edge of the first leg of the angular bracket member integrally with a first side edge of the first leg of the angular bracket member integrally with a first side edge of the base member, and is swung into a position in which it abuts against the base member in the installation position, the connecting portion defining the axis of the swinging, said locking means comprising at least one lug at a second side edge of the base member opposite said first edge, which lug in the installation position is folded to be received in a corresponding cut-out at or near a second edge of the first leg opposite said first edge and abuts against the outer side thereof, wherein said adjusting means comprises at least one slot having an upper and a lower end, and wherein said first leg is provided with at least one recess which in the installation position overlaps the lower end of said at least one slot.

20. A mounting bracket as claimed in claim 16, wherein said adjusting means comprises at least one slot, each of which having a portion extending obliquely in the plane of the base member.

21. A mounting bracket as claimed in claim 20, wherein said adjusting means comprises two slots having mutually parallel and obliquely extending portions, and wherein each end portion of said slots forms a recess constituting said fastening means receiving openings.

22. A mounting bracket as claimed in claim 15, wherein means are provided for temporary securing of the first leg of the angular bracket member in relation to the base member in the transportation position.

23. A mounting bracket as claimed in claim 22, wherein said securing means comprise at least one lug at a respective side edge of the base member, each of said lugs being adapted to cooperate with a corresponding cut-out in a respective side edge of the first leg of the angular bracket member.

24. A bracket member as claimed in claim 23, wherein said at least one lug at one side edge of the base member, in the transportation position, protrudes at an angle of substantially 90° from the plane of the base member, whereas the at least one lug at the other side edge is folded and forms a smaller angle with said plane.

25. A mounting bracket for use in the installation of a roof penetrating structure, wherein said mounting bracket comprises:

an angular bracket member having a first and a second leg connected integrally with each other, and a substantially plate-shaped base member having at least one opening for receiving fastening means, said base member defining a plane, the angular bracket member being connected with the base member in such a way that, in a transportation position, the second leg of said angular bracket member protrudes inwards in relation to said plane, whereas in an installation position, the second leg protrudes outwards in relation to said plane, wherein locking means are provided for locking the first leg of the angular bracket member in relation to the base member in the installation position, and adjusting means are provided for adjusting the position of the angular bracket member in a direction parallel to the substantially plate-shaped base member, wherein means are provided for temporary securing of the first leg of the angular bracket member in relation to the base member in the transportation position, wherein said securing means comprises at least one lug at a respective side edge of the base member, each of said lugs being adapted to cooperate with a corresponding cut-out in a respective side edge of the first leg of the angular bracket member, wherein said at least one lug at one side edge of the base member, in the transportation position, protrudes at an angle of substantially 90° from the plane of the base member, whereas the at least one lug at the other side edge is folded and forms a smaller angle with said plane, and wherein each lug of the base member in the installation position is folded to abut against the outer side of the first leg of the angular bracket member.

26. A mounting bracket for use in the installation of a roof penetrating structure, wherein said mounting bracket comprises:

an angular bracket member having a first and a second leg connected integrally with each other, and a substantially plate-shaped base member having at least one opening for receiving fastening means, said base member defining a plane, the angular bracket member being connected with the base member in such a way that, in a transportation position, the second leg of said angular bracket member protrudes inwards in relation to said plane, whereas in an installation position, the second leg protrudes outwards in relation to said plane, wherein locking means are provided for locking the first leg of the angular bracket member in relation to the base member in the installation position, and adjusting means are provided for adjusting the position of the angular bracket member in a direction parallel to the substantially plate-shaped base member, wherein means are provided for temporary securing of the first leg of the angular bracket member in relation to the base member in the transportation position, wherein said securing means comprise at least one lug at a respective side edge of the base member, each of said lugs being adapted to cooperate with a corresponding cut-out in a respective side edge of the first leg of the angular bracket member, and wherein each side edge of the first leg of the angular bracket member comprises at least two cut-outs, and the first leg is provided with a slot which in the installation position overlaps at least one of said at least one opening in the base member.

27. A mounting bracket for use in the installation of a roof penetrating structure, wherein said mounting bracket comprises:

an angular bracket member having a first and a second leg connected integrally with each other, and a substantially plate-shaped base member having at least one opening for receiving fastening means, said base member defining a plane, the angular bracket member being connected with the base member in such a way that, in a transportation position, the second leg of said angular bracket member protrudes inwards in relation to said plane, whereas in an installation position, the second leg protrudes outwards in relation to said plane, wherein locking means are provided for locking the first leg of the angular bracket member in relation to the base member in the installation position, adjusting means are provided for adjusting the position of the angular bracket member in a direction parallel to the substantially plate-shaped base member, and wherein the base member comprises a raised portion defining a plane situated at a distance from the plane of the remaining portion of the base member, thereby forming a gap for receiving the first leg of the angular bracket member, said locking means and adjusting means comprising a tongue which in one end is fastened to the raised portion of the base member in the vicinity of a side edge thereof and which at a distance from said end is provided with a projection protruding inwards through a hole in the raised portion of the base member and cooperates with a corresponding hole in the first leg of the angular bracket member.

28. A mounting bracket as claimed in claim 27, wherein a plurality of holes are provided in the first leg.

* * * * *